US006058551A

United States Patent [19]

Tagliavini

[11] Patent Number: 6,058,551

[45] Date of Patent: May 9, 2000

[54] ARTICULATED BROOM

[75] Inventor: Matteo Tagliavini, Cicognara di Viadana, Italy

[73] Assignee: Nobel Di Tagliavini Cesare E C. S.n.c., Cicognara Di Viadana, Italy

[21] Appl. No.: 09/238,606

[22] Filed: Jan. 28, 1999

[30] Foreign Application Priority Data

Feb. 2, 1998 [IT] Italy ..... MN98A0002

[51] Int. Cl.[7] ..... A46B 29/17

[52] U.S. Cl. ..... 15/172; 15/144.1; 403/84; 403/102

[58] Field of Search ..... 15/172, 144.1, 15/299.2; 403/84, 99, 102

[56] References Cited

U.S. PATENT DOCUMENTS 2,887,710 5/1959 Mahoney ..... 15/172

FOREIGN PATENT DOCUMENTS 0412060 2/1991 European Pat. Off. .
4241596 8/1993 Germany .
287826 4/1953 Switzerland .

*Primary Examiner*—Terrence R. Till
*Assistant Examiner*—Kaj K. Olsen
*Attorney, Agent, or Firm*—Guido Modiano; Albert Josif; Daniel O'Byrne

[57] ABSTRACT

An articulated broom, comprising a joint located between a base having an attachment plane for the bristles and the end of the handle, said joint comprising a pin connected to said base and adapted to allow the rotation of a hub at the end of the handle, said hub being attached to said pin so as to provide a certain amount of friction therebetween; abutment elements of the hub being provided in a first end position in which the handle is perpendicular to the bristle attachment plane, and a second end position.

8 Claims, 1 Drawing Sheet

ARTICULATED BROOM

BACKGROUND OF THE INVENTION

The present invention relates to an articulated broom.

A number of different brooms are currently commercially available which have a joint between the handle and the base comprising an attachment plane for the bristles which, during use, make contact with the surfaces to be cleaned.

All conventional brooms however have only a limited functionality and are complicated from the structural point of view.

SUMMARY OF THE INVENTION

The aim of the present invention is to provide an articulated broom which is very simple from the structural point of view.

Within the scope of this aim, an object of the present invention is to provide an articulated broom which has a high functional efficiency, offers a wide range of operating possibilities, and is user-friendly.

This aim, this object and others which will become apparent hereinafter are achieved by an articulated broom according to the invention, characterized in that it comprises a joint located between a base having an attachment plane for the bristles and the end of the handle, said joint comprising a pin connected to said base and adapted to allow the rotation of a hub which is located at the end of the handle and attached to said pin in such a way as to provide a certain amount of friction therebetween; abutment means of the hub being provided in a first end position in which the axis of the handle is perpendicular to the bristles attachment plane, and in a second end position, whereby rotation of the hub is allowed in only one direction starting from said first end position.

BRIEF DESCRIPTION OF THE DRAWINGS

Further characteristics and advantages of the present invention will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 2:
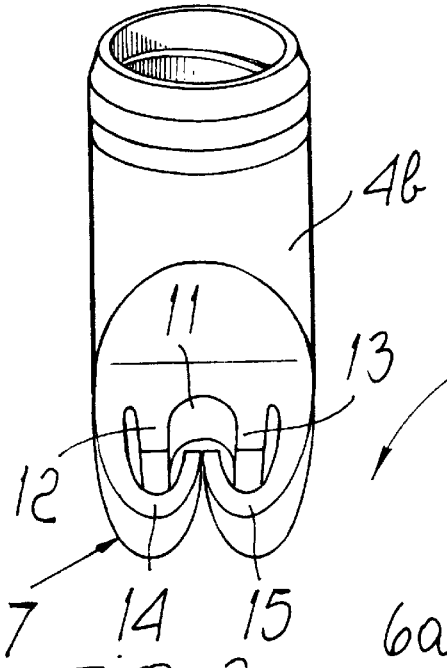
FIG. 2 shows the detail of the hub located at the end of the handle.

With reference to the above figures, 1 generally designates the base of the broom which is provided with an attachment plane 2 for the bristles 3. The longitudinal axis of said base is designated by 1*a*. The handle 4 of the broom extends along an axis 4*a* and has its lower end shaped as a bushing 4*b* which is rigidly coupled to said handle.

Between the base 1 and the handle 4 a joint is located which comprises a pin 5 having an axis 5*a*. The pin is connected to said base, by extending from and being monolithical with two faces 6*a*, 6*b* forming part of the base. Said pin is adapted to allow the rotation of a hub 7 extending from the bushing 4*b*, and being monolithical therewith, at the lower end of the handle 4.

Particularly, the axis 5*a* of the pin 5 is contained in a plane perpendicular to the longitudinal axis 1*a* of the base 1, and forms an angle 8 being substantially of 45° (see FIG. 3) with respect to the attachment plane 2 of the bristles 3. The hub 7 is also inclined, at an angle indicated with 9 in FIG. 3, being substantially of 4520 with respect to the axis 4*a* of the handle 4.

Figure 3:
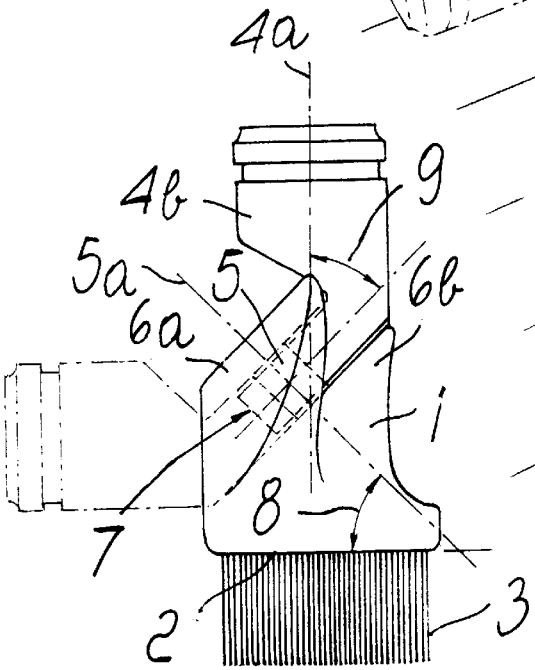
FIG. 3 is a side view of the broom with the handle in the same conditions as depicted in FIG. 1.
Figure 1:
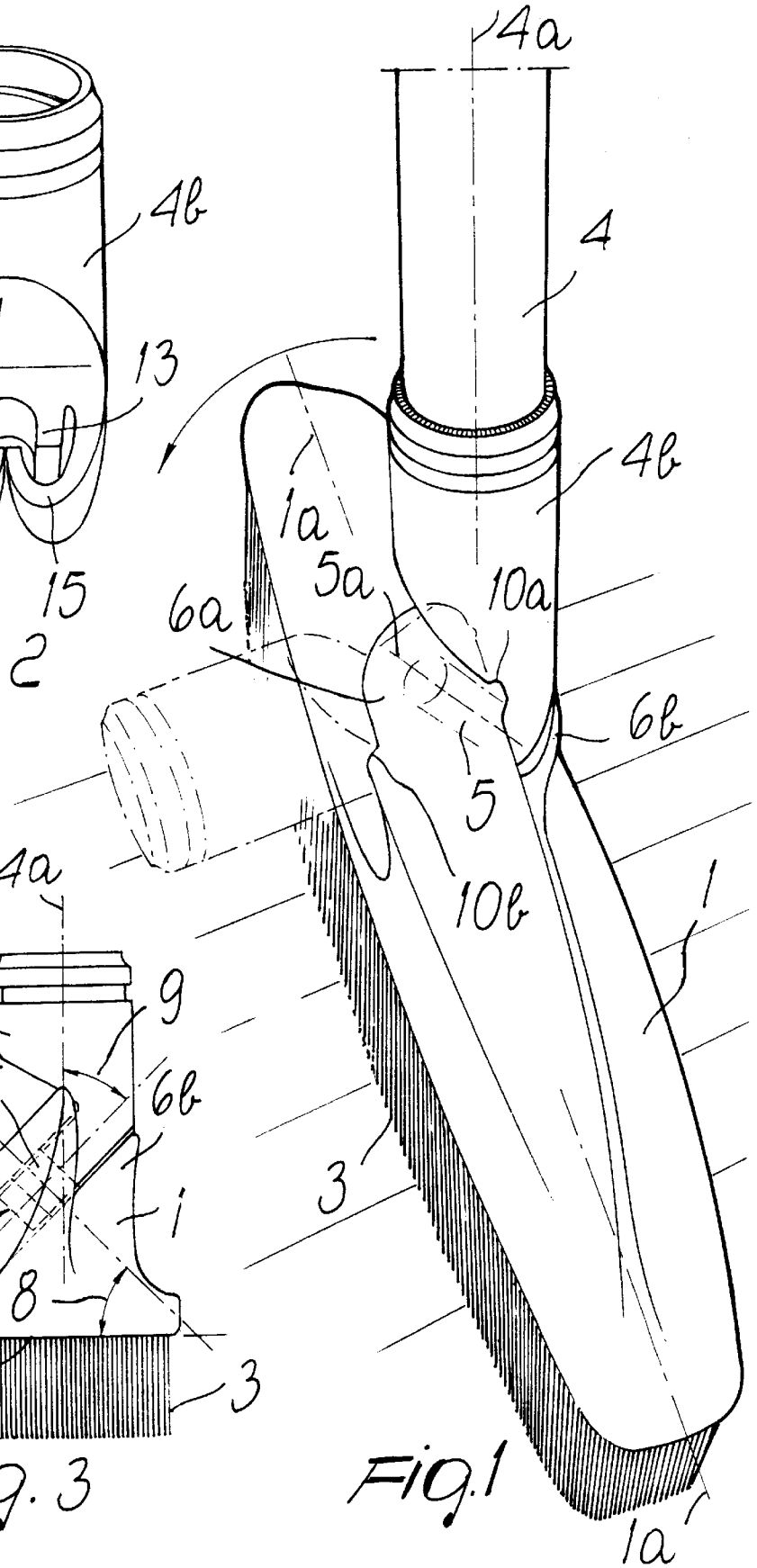
FIG. 1 is a perspective view of the broom with the handle thereof represented in its two stroke end positions, respectively illustrated with a solid line and a chain-dot line.

Therefore, it is possible to rotate the handle of the broom, in a plane being perpendicular to said attachment plane 2, between the two end positions shown in FIGS. 1 and 3: a first position, shown in solid lines, in which the handle 4 has its axis 4*a* perpendicular to the attachment plane 2 for the bristles, and a second position, shown in chain-dot lines, in which the axis of said handle is parallel to said plane 2 while being still perpendicular with respect to the longitudinal axis 1*a* of the base 1.

The broom according to the invention is provided with abutment means for the hub 7 at the two end positions, which consists of teeth 10*a*, 10*b*. Thus the rotation of 180° from the first to the second end positions can only take place in the direction indicated by the arrow in FIG. 1.

The presence of teeth 10*a*, 10*b* ensures that the handle 4 is held in position when it is in either of the two end positions. The handle can further assume several intermediate positions during rotation thereof between the two end positions. In this manner the broom has greater handling capability in all situations. These intermediate positions are maintained thanks to the friction provided between the hub 7 and the faces 6*a*, 6*b* from which the pin 5 extends.

For a more detailed description of the hub 7, it will be noted that said hub comprises a housing 11 for the pin 5 adapted to enclose said pin along an arcuated surface substantially equal to a semi-circumference ending with two lugs 12, 13. Two wings 14, 15 extend from the hub body parallel to the lugs 12, 13 and bend towards the housing 11 so as to provide therealong a complete retention of the pin 5. In this way the wings also achieve the necessary elasticity to allow the insertion of said pin 5 therebetween, when said pin is placed into the housing 11.

The invention thus conceived is susceptible to numerous modifications and variations all of which are within the scope of the inventive concept.

For example, the friction that the hub 7 meets during its rotation can be provided by its contact with the pin 5. Moreover, abutment means for the hub, suitably located, may allow the rotation between a first end position, such as that mentioned above, and any other second end position.

The disclosures in Italian Patent Application No. MN98A000002 from which this application claims priority are incorporated herein by reference.

What is claimed is:

1. An articulated broom, comprising: a base extending along a longitudinal axis thereof and having an attachment plane for bristles; a handle connected to said base at an end thereof; a joint located between said base and the end of the handle, said joint including a pin connected to said base; a hub located at the end of the handle, said hub being attached to said pin so as to rotate thereon with friction; and abutment means for providing abutment to said hub at a first end position in which the handle is placed with a longitudinal axis thereof perpendicular to said bristle attachment plane, and at a second end position, and wherein the hub is rotatable between said two end positions in one direction only as starting from said first end position.

2. The articulated broom of claim 1, wherein said abutment means delimit said second end position in which said handle has the axis thereof parallel to said attachment plane and perpendicular to said longitudinal axis of the base.

3. The articulated broom of claim 2, wherein said pin is arranged in a plane perpendicular to said longitudinal axis of the base, along a direction forming with said attachment plane an angle being substantially of 45°, said hub being located at the end of the handle so as to be inclined with respect to the longitudinal axis of said handle by an angle of substantially 45°.

4. The articulated broom of claim 3, comprising two faces formed monolithically with said base, said pin being connected to, and extending between said two faces.

5. The articulated broom of claim 4, wherein said hub is associated with said pin in friction contact with said two faces between which said pin extends.

6. The articulated broom of claim 4, wherein said hub is associated with said pin so as to provide therebetween friction contact forces.

7. The articulated broom of claim 4, wherein said hub comprises: a body forming a housing for the pin, said housing enclosing said pin on an arcuated surface thereof being substantially equal to a semi-circumference; two substantially straight lugs formed at opposite ends of said arcuated surface; and two wings extending from the hub body parallel to said lugs, said wings bending towards said housing with terminal ends thereof facing said housing.

8. An articulated broom, comprising: a base extending along a longitudinal axis thereof and having an attachment plane for bristles; a handle connected at an end thereof to said base; a joint located between said base and the end of the handle, said joint comprising a pin connected to said base; a hub located at the end of the handle and having a body forming a housing for enclosing said pin on an arcuated surface being substantially equal to a semi-circumference; two substantially straight lugs formed at opposite ends of said hub body; and two wings extending from the hub body parallel to said lugs and bending towards said housing with end portions thereof facing said housing.

* * * * *